US010480101B2

(12) United States Patent
Duralti et al.

(10) Patent No.: US 10,480,101 B2
(45) Date of Patent: Nov. 19, 2019

(54) CABLING SPINDLE

(71) Applicant: Saurer Germany GmbH & Co. KG, Remscheid (DE)

(72) Inventors: Cenk Duralti, Mönchengladbach (DE); Katrin Kolk, Dormagen (DE); Sergei Singer, Krefeld (DE)

(73) Assignee: SAURER SPINNING SOLUTIONS GMBH & CO. KG, Uebach-Palenberg (DE)

( * ) Notice: Subject to any disclaimer, the term of this patent is extended or adjusted under 35 U.S.C. 154(b) by 20 days.

(21) Appl. No.: 15/331,974

(22) Filed: Oct. 24, 2016

(65) Prior Publication Data

US 2017/0130367 A1 May 11, 2017

(30) Foreign Application Priority Data

Nov. 6, 2015 (DE) ..... 20 2015 007 655 U

(51) Int. Cl.

*D01H 1/10* (2006.01)
*D01H 7/86* (2006.01)
*D01H 1/00* (2006.01)

(52) U.S. Cl.

CPC ..... *D01H 1/105* (2013.01); *D01H 1/006* (2013.01); *D01H 7/86* (2013.01)

(58) Field of Classification Search

CPC ..... D01H 1/10; D01H 1/101; D01H 1/103; D01H 1/105; D01H 1/106; D01H 1/166

See application file for complete search history.

(56) References Cited

U.S. PATENT DOCUMENTS 2,095,644 A * 10/1937 Lenk ..... D01H 1/10 242/130
2,127,921 A * 8/1938 Kent ..... D01H 1/106 57/58.74
2,374,085 A * 4/1945 Gwaltney ..... D01H 1/106 57/58.7
2,597,015 A * 5/1952 May ..... D01H 1/106 192/17 R
2,613,886 A * 10/1952 Roberts ..... B65H 59/22 242/149
2,811,013 A * 10/1957 Klein ..... D01H 1/106 242/154
2,869,315 A * 1/1959 Klein ..... D01H 1/101 57/315
2,871,648 A * 2/1959 Vibber ..... D01H 13/108 57/58.36
2,932,150 A * 4/1960 Keith ..... D01H 1/106 57/353
3,007,299 A * 11/1961 Starnes ..... D01H 1/427 57/315

(Continued)

FOREIGN PATENT DOCUMENTS

DE 3708331 C1 7/1988
DE 10220302 A1 12/2003

*Primary Examiner* — Shaun R Hurley
(74) *Attorney, Agent, or Firm* — Nelson Mullins Riley & Scarborough LLP

(57) ABSTRACT

A cabling spindle 2 comprising a spindle pot 5 and an upper part which is constituted as a conical cabling hood 1, wherein a yarn brake 7 is arranged in the cabling hood 1. According to the invention, the cabling hood 1 merges in its upper region from the conical shape into a convex shape.

2 Claims, 2 Drawing Sheets

(56) References Cited

U.S. PATENT DOCUMENTS

| | | | | | |
|---|---|---|---|---|---|
| 3,052,080 | A * | 9/1962 | Otten | D01H 1/10 | 57/58.49 |
| 3,277,640 | A * | 10/1966 | Colombu | B65H 59/38 | 57/58.86 |
| 3,377,790 | A * | 4/1968 | Brockel | D01H 1/101 | 57/58.59 |
| 3,605,394 | A * | 9/1971 | Vibber | B65H 59/384 | 57/264 |
| 3,782,087 | A * | 1/1974 | Franzen | D01H 1/166 | 181/205 |
| 4,112,667 | A * | 9/1978 | Hatcher | D01H 1/10 | 57/310 |
| 4,185,451 | A * | 1/1980 | Hatcher | D01H 1/10 | 57/310 |
| 4,315,397 | A * | 2/1982 | Matas Gabalda | D01H 1/106 | 57/58.49 |
| 4,754,599 | A * | 7/1988 | Siebert | D01H 1/10 | 57/58.49 |
| 6,035,620 | A * | 3/2000 | Kallmann | D01H 7/86 | 57/354 |
| 2013/0074468 | A1* | 3/2013 | Guggemos | B65H 54/74 | 57/58.83 |

* cited by examiner

CABLING SPINDLE

CROSS-REFERENCE TO RELATED APPLICATIONS

This application claims priority from German National Patent Application No. DE 202015007655.6, filed Nov. 6, 2015, entitled "Kablierspindel", the entire contents of which are incorporated herein by reference.

FIELD OF THE INVENTION

The invention relates to a cabling spindle comprising a spindle pot and an upper part which is constituted as a conical cabling hood, wherein a yarn brake is arranged in the cabling hood.

BACKGROUND OF THE INVENTION

Cabling or respectively cording is a textile process for improving yarn quality, since the single yarn does not always meet requirements with regard to strength and uniformity for further processing or in the finished product. Within the scope of this application, the term yarn is taken to include all linear structures, such as yarns, threads, foil strips, tubular and strip-shaped textiles and similar. For reasons of simplicity, within the scope of this application, the term yarn is used with the same meaning for the possible alternatives.

A cabling machine comprises a plurality of workstations which are arranged side-by-side in the longitudinal direction of the machine. The workstations each comprise a spindle onto which a feed bobbin is plugged and a plug-on device arranged on the machine frame, which serves to accommodate a second feed bobbin. The yarns are taken up from the feed bobbins, and their tension is kept constant via yarn brakes. In this context, the yarn from the first feed bobbin in the spindle pot, which is conventionally designated as a pot yarn, is taken up overhead. The other yarn from the second feed bobbin on the machine frame, the so-called creel yarn, is introduced into the hollow spindle from below and emerges from the spindle on a storage disk, winds partially around the latter and rotates around the spindle pot as a yarn balloon. In the balloon yarn-guide, the yarn of the second feed bobbin winds around the yarn of the first feed bobbin, without the individual yarns receiving rotations. The yarn manufactured by this process is wound onto a winding-on bobbin.

German Patent Publication DE 37 08 331 C1 describes a method and a device for the adjustment of the yarn-tension ratio between outer and inner yarns in the manufacture of cabled technical yarns. The outer yarn or creel yarn is taken up from a feed bobbin and runs through a yarn-brake device and an axial channel of a spindle, from which it emerges through a radial channel and forms a yarn balloon around the spindle. A yarn-guide eye is arranged above the apex of the yarn balloon. The inner yarn or pot yarn, which is taken up from a feed bobbin, which is arranged above the spindle in the interior of the yarn balloon inside a bobbin pot, is supplied just below the yarn-guide eye. FIG. 1 shows a dome-shaped cabling hood which comprises a horizontal flattening in the uppermost region.

By contrast with German Patent Publication DE 37 08 331 C1, instead of operating with a so-called open yarn balloon, a balloon limiter is used in German Patent Publication DE 102 20 302 A1.

German Patent Publication DE 102 20 302 A1 discloses a cabling spindle with a spindle pot, the upper part of which is formed by a cabling hood, which is constituted in a truncated-conical shape. Furthermore, the spindle pot is surrounded by a balloon limiter constituted in a cylindrical manner. The creel yarn is guided upwards in the interspace between the outside of the spindle pot and the internal wall of the balloon limiter and through the balloon yarn-guide eye. Such a balloon limiter can be used in cabling machines in order to narrow the rotating yarn balloon formed by the running yarn.

The disadvantage with cabling spindles according to the prior art is that the energy consumption of such cabling spindles is relatively high because of the yarn balloon occurring.

SUMMARY OF THE INVENTION

Starting from cabling spindles of the above-named type, the present invention is based upon the object of proposing a cabling spindle by means of which the energy consumption is reduced.

Cabling spindles to which the present invention is applicable basically comprise a spindle pot and an upper part which is constituted as a conical cabling hood, with a yarn brake arranged in the cabling hood. According to the invention, the cabling hood merges in its upper region from the conical shape into a convex shape.

With such an advantageous embodiment of the cabling hood, the substantial part of the cabling hood is constituted in a conical manner and merges in the region of the top surface of the truncated cone into a convex shape. In this context, the transition of the lateral surface into the top surface is rounded.

Through the geometric adaptation of the cabling hood with regard to the natural formation of the resulting yarn balloon, the balloon yarn-guide eye can be arranged closer to the cabling hood, without the creel yarn coming into contact with the cabling hood. As a result of the displacement of the balloon yarn-guide eye towards the cabling hood, only a smaller yarn balloon can be formed. The smaller the yarn balloon is, the lower the energy consumption of the cabling spindle will be.

Even during start-up and warm-up, it is still guaranteed by the cabling hood constituted according to the invention that the creel yarn does not touch the cabling hood.

A further advantage is that, for the use of a cabling hood according to the invention, it is irrelevant whether an open yarn balloon is formed or a balloon limiter is used; in both processes, the advantages according to the invention are achieved. A cabling hood according to the invention can be used in combination with a conventional spindle pot manufactured through mass production. Existing cabling machines can even be retrospectively fitted with such an advantageous cabling hood, without the need for a complicated and effort-intensive conversion of the cabling machine.

Within the scope of the invention, it is, of course, possible to constitute the cabling hood with different diameters and heights. Similarly, it is conceivable that the cabling hood according to the invention is manufactured from extremely diverse materials, wherein the cabling hood can be manufactured from a homogeneous material or from material mixtures or respectively treated/coated/alloyed materials.

In one advantageous embodiment, the cabling hood is constituted in its upper region as a spherical calotte.

Such a dome-shaped embodiment can be advantageous dependent upon the fineness of the yarn to be processed.

BRIEF DESCRIPTION OF THE DRAWINGS

In the following, the invention is explained in greater detail on the basis of an exemplary embodiment with reference to the accompanying drawings, wherein.

DETAILED DESCRIPTION OF THE INVENTION

Figure 1:
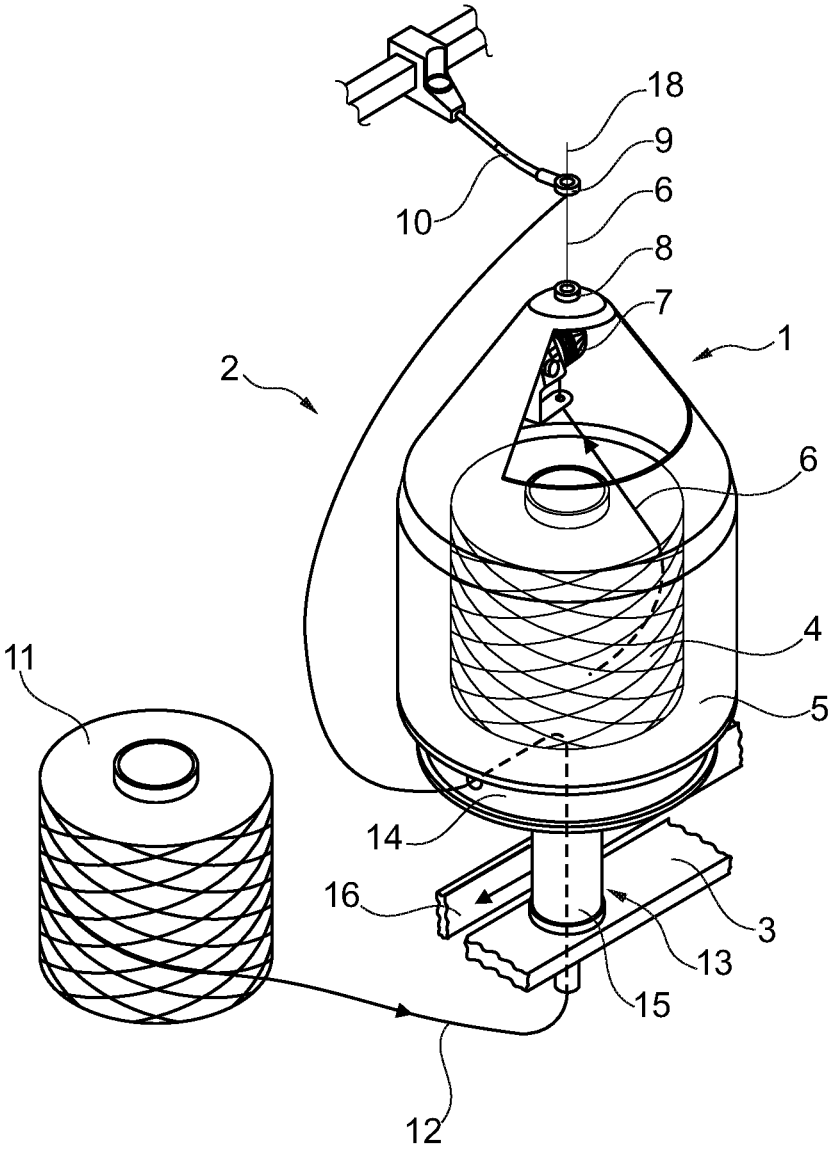
FIG. 1 is a schematically illustrated workstation of a cabling machine with cabling hood according to the invention.

FIG. 1 shows schematically a workstation of a cabling machine with cabling hood 1 according to the invention.

The cabling spindle 2 is mounted on a spindle rail 3. A first feed bobbin 4 is disposed in the spindle pot 5 of the cabling spindle 2. The pot yarn 6 is taken up overhead from the first feed bobbin 4 and guided through a yarn brake 7 arranged in the cabling hood 1. After the yarn brake 7, the pot yarn 6 leaves the cabling hood 1 through a yarn-guide eye 8 and finally passes through a downstream balloon yarn-guide eye 9. The balloon yarn-guide eye 9 is attached by means of a holder 10 to the machine frame, which is merely suggested.

A second feed bobbin 11 is conventionally mounted on a plug-on device arranged on the machine frame, and illustrated only schematically here alongside the cabling spindle 2. The creel yarn 12 taken up from the second feed bobbin 11 passes through the hollow spindle axis 13 from below, is deflected in the radial direction and emerges radially on the yarn-storage disk 14. The rotatory drive of the yarn-storage disk 14 is implemented via a spindle whorl 15 from a drive belt 16.

Emerging from the yarn-storage disk 14, the creel yarn 12 is guided upwards on the outside of the spindle pot 5 to the balloon yarn-guide eye 9. Here, the creel yarn 12 is looped around the pot yarn 6 and the twine 18 manufactured in this manner is further wound onto the winding-on bobbin.

Figure 2:
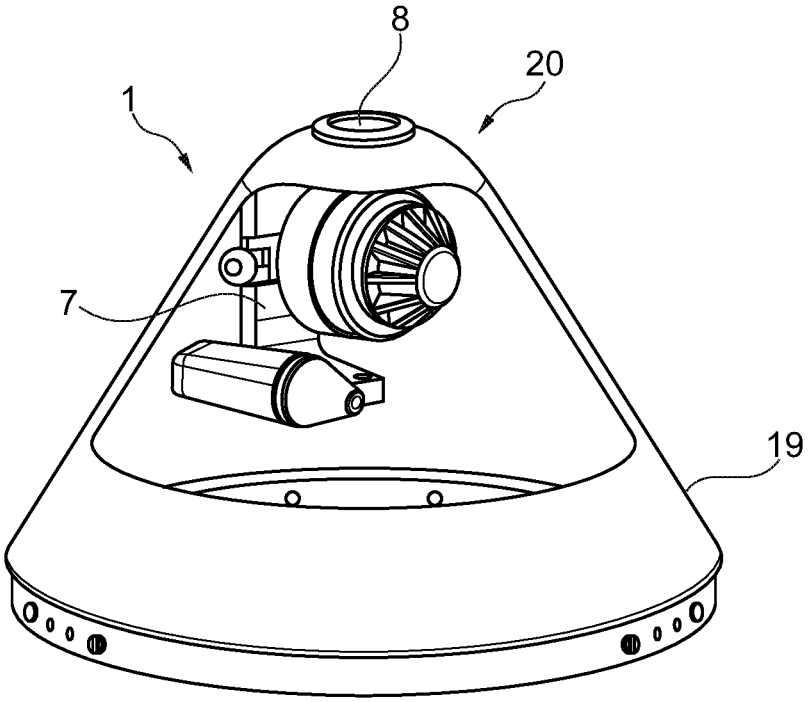
FIG. 2 is an enlarged illustration of the cabling hood according to the invention.

FIG. 2 shows the cabling hood 1 according to the invention. The lateral surface 19 of the cone merges into a convex shape of the top surface 20. Through an embodiment of this kind, including the rounded transition, the geometric shape of the cabling hood 1 is approximated to the shape of the resulting yarn balloon. As a result, the balloon yarn-guide eye 9 can be arranged close to the cabling hood 1, the resulting yarn balloon is smaller, so that ultimately energy is saved.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Cabling spindle, comprising a spindle pot and an upper part which is constituted as a conical cabling hood having a top surface, wherein a yarn brake is arranged in the cabling hood, characterized in that, the cabling hood merges in its upper region from the conical shape into a: convex shape, and wherein the cabling hood has a yarn-guide eye that passes through the top surface of the cabling hood.

2. Cabling spindle according to claim 1, characterized in that the cabling hood is constituted in its upper region as a spherical calotte.

* * * * *